US008997289B2

(12) United States Patent
Bang et al.

(10) Patent No.: US 8,997,289 B2
(45) Date of Patent: Apr. 7, 2015

(54) WASHING MACHINE AND CONTROL METHOD THEREOF

(75) Inventors: Eun Suk Bang, Hwaseong-si (KR); Hyun Sook Kim, Suwon-si (KR); So Jung Yu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 928 days.

(21) Appl. No.: 12/801,312

(22) Filed: Jun. 2, 2010

(65) Prior Publication Data

US 2011/0056030 A1 Mar. 10, 2011

(30) Foreign Application Priority Data

Sep. 10, 2009 (KR) ..... 10-2009-0085296

(51) Int. Cl.
*D06F 33/02* (2006.01)
*D06F 35/00* (2006.01)

(52) U.S. Cl.
CPC ..... *D06F 33/02* (2013.01); *D06F 35/002* (2013.01); *D06F 35/006* (2013.01)

(58) Field of Classification Search
USPC ..... 8/158, 159; 68/12.05, 12.18, 12.19, 68/12.21, 17 R, 23 R, 24
See application file for complete search history.

(56) References Cited

U.S. PATENT DOCUMENTS 4,118,189 A * 10/1978 Reinwald et al. ..... 8/137
5,253,380 A * 10/1993 Lim et al. ..... 8/158
5,295,373 A * 3/1994 Lim et al. ..... 68/12.05
5,307,649 A * 5/1994 Lim et al. ..... 68/12.05
5,590,551 A * 1/1997 Hong ..... 68/183
5,653,129 A * 8/1997 Jang ..... 68/13 R
6,094,948 A * 8/2000 Hong et al. ..... 68/183
6,139,587 A * 10/2000 Nair et al. ..... 8/138
6,170,303 B1 * 1/2001 Hong et al. ..... 68/183
6,868,701 B2 * 3/2005 Lee ..... 68/183
7,530,134 B2 * 5/2009 Frucco et al. ..... 8/159
8,347,437 B2 * 1/2013 Kim et al. ..... 8/149.1
2004/0040344 A1 * 3/2004 Minayoshi et al. ..... 68/12.16
2006/0101590 A1 * 5/2006 Frucco et al. ..... 8/158
2007/0289612 A1 * 12/2007 Minayoshi et al. ..... 134/33
2008/0016626 A1 * 1/2008 Oak et al. ..... 8/158
2008/0099051 A1 * 5/2008 Kim et al. ..... 134/18
2008/0099052 A1 * 5/2008 Lee et al. ..... 134/18

(Continued)

FOREIGN PATENT DOCUMENTS

EP 1 918 441 5/2008
GB 2145119 A * 3/1985 ..... D06F 37/38

(Continued)

OTHER PUBLICATIONS

European Search Report issued Oct. 24, 2014 in corresponding European Patent Application No. 10165908.4.

*Primary Examiner* — Joseph L Perrin
(74) *Attorney, Agent, or Firm* — Staas & Halsey LLP

(57) ABSTRACT

A washing machine and a control method thereof to achieve washing performance using bubbles without damage to fiber structures of functional clothes. When a washing course of functional clothes is selected, a motor is frequently rotated at a period of a predetermined time or less, causing the clothes to uniformly adsorb the water. Thereafter, bubbles are generated and applied to the clothes. A drive operation rate of the motor is raised stepwise to wash the clothes to which the bubbles have been applied, so as to effectively remove sweat, contaminants, or the like contained in the clothes.

12 Claims, 9 Drawing Sheets

(56) References Cited

U.S. PATENT DOCUMENTS

| | | | | |
|---|---|---|---|---|
| 2009/0064421 | A1* | 3/2009 | Lee et al. | 8/137 |
| 2009/0139278 | A1* | 6/2009 | Kim et al. | 68/5 C |
| 2009/0241267 | A1* | 10/2009 | Kim et al. | 8/149.1 |
| 2010/0236000 | A1* | 9/2010 | Kim et al. | 8/159 |
| 2010/0263410 | A1* | 10/2010 | Oak et al. | 68/12.05 |

FOREIGN PATENT DOCUMENTS

| | | |
|---|---|---|
| JP | 2008-161352 | 7/2008 |
| KR | 10-2008-00702758 | 7/2008 |
| KR | 10-2009-0046080 | 5/2009 |
| WO | WO 2008/091124 | 7/2008 |

* cited by examiner

FIG. 9

| WATER REPELLENCY GRADE | ILLUSTRATION |
|---|---|
| FIFTH GRADE (100) | CLOTHES SURFACE HAVE NO ADHESION AND WETTING |
| FOURTH GRADE (90) | CLOTHES SURFACE HAVE A LITTLE ADHESION AND WETTING |
| THIRD GRADE (80) | REGION OF CLOTHES SURFACE IN CONTACT WITH WATER BECOMES WET |
| SECOND GRADE (70) | ENTIRE CLOTHES SURFACE IS PARTIALLY WET |
| FIRST GRADE (50) | CLOTHES SURFACE AND OPPOSITE SIDE ARE COMPLETELY WET |

WASHING MACHINE AND CONTROL METHOD THEREOF

CROSS-REFERENCE TO RELATED APPLICATIONS

This application claims the benefit of Korean Patent Application No. 2009-0085296, filed on Sep. 10, 2009 in the Korean Intellectual Property Office, the disclosure of which is incorporated herein by reference.

BACKGROUND

1. Field

Embodiments relate to a washing machine and a control method thereof to achieve washing performance using bubbles without damage to fiber structures of functional clothes.

2. Description of the Related Art

Generally, a washing machine (normally, a drum washing machine) includes a water tub in which water (wash water or rinse water) is received, a drum rotatably mounted in the water tub, in which laundry fabric (hereinafter, referred to as fabric) is received, and a motor to generate drive force required to rotate the drum. The washing machine washes the fabric received in the drum via an action by which the fabric repeatedly rises along an inner wall of the drum and falls during rotation of the cylindrical drum.

The washing machine performs a series of operations, such as, e.g., a washing operation, a rinsing operation, and a dehydrating operation. The washing operation serves to separate contaminants from the fabric using detergent dissolved water (i.e. wash water). The rinsing operation serves to rinse bubbles or residual detergent out of the fabric using water containing no detergent (i.e. rinse water). The dehydrating operation serves to dehydrate the fabric via high speed rotation. Of these operations, more particularly, the washing operation is carried out in such a manner that water and detergent are input into the water tub when a user selects a washing course and thereafter, the detergent dissolved water is directed to the fabric via rotation of the drum, causing the fabric to be washed using falling force.

However, in the case of functional clothes, more particularly, sports clothes, such as, e.g., hiking clothes, ski wear, and golf wear, clothing surface or fiber structures may be substantially influenced by mechanical force. Therefore, to wash functional clothes with high performance, it may be necessary to effectively remove sweat, contaminants, etc. while maintaining the surface or fiber structures of the functional clothes, i.e. maintaining the functionality of the functional clothes.

Hiking clothes or ski wear have a special function of rapidly discharging sweat generated by the body while preventing invasion of snow, rainwater, etc. To realize this function, materials having coating, adhesion, and other special fiber structures are used. Functions of these materials may easily be destroyed due to surface damage under general washing conditions and alternatively, may exhibit malfunction as pores thereof are blocked by sweat, contaminants (dirt), etc. when repeatedly worn without washing.

Accordingly, without proper care functional clothes gradually become unsuitable for their intended purpose. Therefore, there is a need for a washing course suitable for functional clothes.

Recently developed washing machines have a washing course to wash functional clothes, such as sports clothes, outdoor clothes, etc. However, most of the recent washing machines only wash functional clothes by using mechanical force that is approximately half of a standard course and a delicate course to attempt to minimize damage to clothes. This has substantial drawbacks since maintaining the washing performance may cause deterioration in the functionality of the functional clothes, whereas maintaining the functionality of the functional clothes may result in deterioration of washing performance. Accordingly, there is a need for a control method to satisfy both the washing performance while maintaining functionality of the functional clothes.

SUMMARY

Therefore, it is an aspect to provide a washing machine and a control method thereof to achieve washing performance using bubble washing without damage to the surface or fiber structures of functional clothes.

Additional aspects will be set forth in part in the description which follows and, in part, will be apparent from the description, or may be learned by practice of the embodiments.

In accordance with one aspect, a control method of a washing machine having a drum to receive clothes therein and a motor to rotate the drum includes determining whether a washing course of functional clothes is selected, generating bubbles of detergent dissolved water to apply the bubbles to the clothes, and raising a drive operation rate of the motor stepwise to wash the clothes to which the bubbles have been applied.

The functional clothes may include hiking clothes, ski wear, or golf wear.

The generation of the bubbles may include preparing the detergent dissolved water by supplying the water and detergent into a water tub, heating the detergent dissolved water to a preset temperature, and ejecting air droplets into the heated detergent dissolved water, so as to generate the bubbles.

The preset temperature may be set to 30° C. or less, so as not to damage the functional clothes.

The stepwise raising of the drive operation rate of the motor may include driving the motor at a first operation rate to prevent the clothes from clumping while soaking the clothes, and driving the motor at a second operation rate higher than the first operation rate to wash the clothes using mechanical force.

The first operation rate may be 2 seconds On/38 seconds Off, and the second operation rate may be 4 seconds On/58 seconds Off.

A total operation time of the motor when the motor is operated at the first operation rate and the second operation rate may be within a second time.

The second time may be approximately 6 minutes.

The control method may further include performing a wetting operation to cause the clothes to adsorb the water by driving the motor at a period of a first time or less prior to the generation of the bubbles when the washing course of the functional clothes is determined.

A drive period of the motor may be the drive operation rate of the motor as the sum of a motor On time and a motor Off time, and the first time is approximately 10 seconds.

The motor On time of the drive period of the motor may be 4 seconds or less.

The control method may further include rotating the drum forward and reverse for a predetermined time after final dehydration, to remove the water remaining on a surface of the clothes.

The control method may further include, when the washing course of the functional clothes is determined, guiding a user to input a predetermined weight or less of the clothes before supply of the water.

The control method may further include, when the washing course of the functional clothes is determined, controlling supply of the water to a preset amount or less without sensing a weight of the clothes.

In accordance with another aspect, a washing machine includes a water tub, a water supply device to supply water into the water tub, a detergent supply device to supply detergent, a circulating device to circulate the water supplied into the water tub, a drum mounted in the water tub to receive clothes therein, a motor to rotate the drum, and a control unit to control the water supply device and the detergent supply device so that the water and the detergent are supplied into the water tub, bubbles of detergent dissolved water are generated, and washing of functional clothes is performed using the bubbles by varying a drive operation rate of the motor stepwise for a washing period.

The control unit may control the motor at a drive period of a first time or less to cause the clothes to adsorb the water prior to performing the washing of the functional clothes using the bubbles.

The circulating device may include a circulating pipe to circulate the detergent dissolved water in the water tub, and an air guidance pipe to introduce air into the circulating pipe, and the control unit may generate the bubbles using the introduced air while circulating the detergent dissolved water present in a bottom region of the water tub using the circulating device.

The control unit may perform a first washing operation by driving the motor at a first operation rate to prevent the clothes from clumping, and a second washing operation by driving the motor at an operation rate higher than the first operation rate to wash the clothes to which the bubbles have been applied using raised mechanical force.

The control unit may limit a motor On time of the drive operation rate of the motor within a second time.

The control unit may control the drum to rotate forward and reverse for a predetermined time, to remove water remaining on a surface of the clothes after final dehydration.

The control unit may guide a weight of the clothes to a user, and may control the water supply device to supply the water to a preset amount or less.

BRIEF DESCRIPTION OF THE DRAWINGS

These and/or other aspects will become apparent and more readily appreciated from the following description of the embodiments, taken in conjunction with the accompanying drawings of which:

FIG. 9 is a table illustrating a valuation basis per water repellency grade.

DETAILED DESCRIPTION

Figure 1:
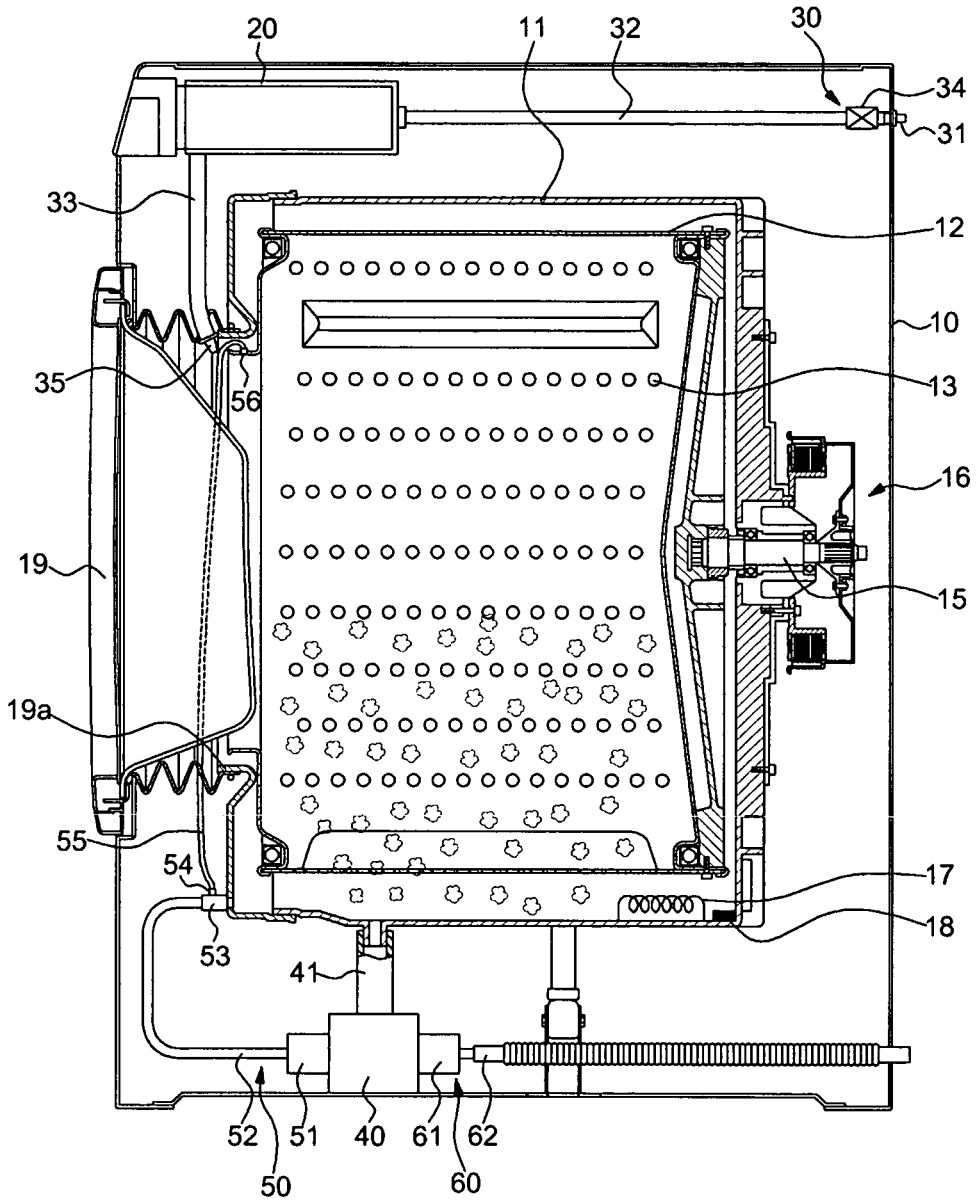
FIG. 1 is a sectional view illustrating a configuration of a washing machine according to an exemplary embodiment.

Reference will now be made in detail to the embodiment, examples of which are illustrated in the accompanying drawings, wherein like reference numerals refer to like elements throughout.

FIG. 1 is a sectional view illustrating a configuration of a washing machine according to the embodiment.

As shown in FIG. 1, the washing machine according to the embodiment includes a body 10, a drum type water tub 11 mounted in the body 10 to receive water (wash water or rinse water) therein, and a cylindrical drum 12 rotatably mounted in the water tub 11, the cylindrical drum 12 having a plurality of holes 13.

A motor 16 as a drive device is mounted to a rear outer surface of the water tub 11 and serves to rotate a rotating shaft 15 connected to the drum 12, to enable performance of washing, rinsing, and dehydrating operations. A washing heater 17 and a water level sensor 18 are mounted in a bottom region of the water tub 11. The washing heater 17 serves to heat the water (i.e. detergent dissolved water) received in the water tub 11. The water level sensor 18 serves to sense the amount of water (water level) received in the water tub 11 by detecting a variable frequency depending on the water level.

The water level sensor 18 controls a wash water level to prevent fabric input into the drum 12 from being completely wetted by the detergent dissolved water. The wash water level is a water level suitable to generate bubbles (hereinafter, referred to as a bubble generation water level) and corresponds to a level of the detergent dissolved water having a height of 5 cm or less from a surface of the drum 12. If the detergent dissolved water supplied for bubble washing reaches the bubble generation water level, the supply of water (wash water) is stopped to prevent the detergent dissolved water from entering the drum 12.

A door 19 having an entrance 19*a* is coupled to a front surface of the body 10 to put fabric into the drum 12 or take the fabric out of the drum 12. A detergent supply device 20 to supply detergent and a water supply device 30 to supply water (wash water or rinse water) are mounted above the water tub 11.

The interior of the detergent supply device 20 is divided into a plurality of spaces. To allow a user to easily input detergent and rinse agent into the respective spaces, the detergent supply device 20 is positioned toward the front surface of the body 10.

The water supply device 30 includes a first water supply pipe 32, a second water supply pipe 33, a water supply valve 34, and a water supply nozzle 35. The first water supply pipe 32 connects the detergent supply device 20 to an external water supply pipe 31 to supply water (wash water or rinse water) into the water tub 11. The second water supply pipe 33 connects the detergent supply device 20 to the water tub 11. The water supply valve 34 is installed on a portion of the first water supply pipe 32 to control the supply of water. The water supply nozzle 35 is installed at an exit of the second water supply pipe 33. With this configuration, the water is supplied into the water tub 11 by way of the detergent supply device 20, allowing the detergent received in the detergent supply device 20 to be supplied into the water tub 11 together with the water.

A circulating device 50 and a drain device 60 are mounted below the water tub 11 symmetrically about a pump case 40. The circulating device 50 serves to circulate the water in the water tub 11, and the drain device 60 serves to drain the water from the water tub 11. A connection hose 41 is interposed between the water tub 11 and the pump case 40 to guide the water from the water tub 11 to the pump case 40.

The circulating device 50 includes a circulating pump 51, a circulating pipe 52, a circulating nozzle 53, an air inlet hole 54, and an air guidance pipe 55. The circulating pump 51 serves to reintroduce the water, guided into the pump case 40, into the water tub 11. The circulating pipe 52 is installed at an exit side of the circulating pump 51 to circulate the water. The circulating nozzle 53 is installed at an exit of the circulating pipe 52 to eject the water into the bottom region of the water tub 11. The air inlet hole 54 is perforated in the circulating nozzle 53 to introduce air into the circulating nozzle 53, the air being used to generate bubbles in the water (i.e. the detergent dissolved water) supplied into the bottom region of the water tub 11. The air guidance pipe 55 has an air suction hole 56 to suction the interior air of the drum 12, the air guidance pipe 55 serving to guide the suctioned air to the air inlet hole 54.

The circulating pipe 52 is connected at one end thereof to the circulating pump 51 and at the other end thereof to the water tub 11. Upon operation of the circulating pump 51, the water received in the water tub 11 is guided into the pump case 40 through the connection hose 41 and then, the water guided into the pump case 40 is reintroduced into the water tub 11 through the circulating pipe 52, resulting in circulation of the water. In this case, to allow the circulating water to be smoothly supplied into the bottom region of the water tub 11, the circulating pipe 52 is connected to the water tub 11 at the lowest position of the water tub 11.

The circulating nozzle 53 is a venturi tube to reduce the pressure of the circulating water, causing the air suctioned through the air suction hole 56 to be naturally introduced into the circulating nozzle 53 through the air guidance pipe 55 and the air inlet hole 54. This air introduction allows the detergent contained in the water to be agglomerated without a separate air supply device, enabling generation of bubbles.

The drain device 60 includes a drain pump 61 to drain the water guided into the pump case 40 to the outside, and a drain pipe 62 installed at an exit side of the drain pump 61 to drain the water.

The circulating device 50 according to the embodiment circulates the water of the water tub 11 to generate bubbles. Hereinafter, a bubble generating process will be described in more detail with reference to FIGS. 2 to 6.

FIGS. 2 to 6 are views illustrating generation of bubbles in the washing machine according to the embodiment.

Figure 2:
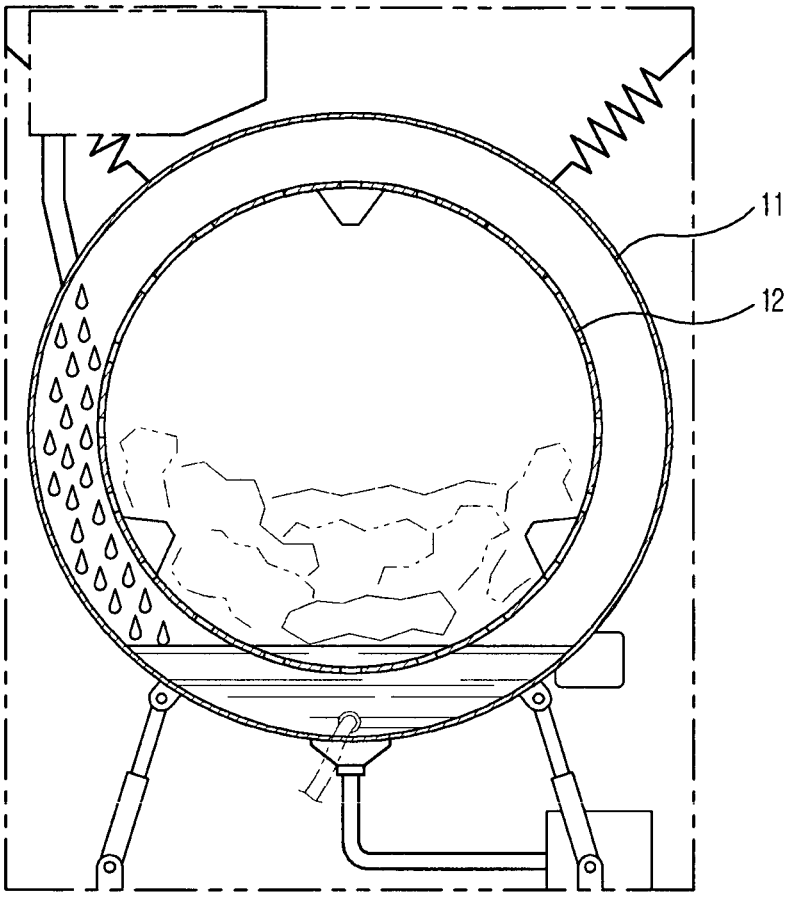
FIGS. 2 to 6 are views illustrating generation of bubbles in the washing machine according to the embodiment.

In FIG. 2, as the water supplied through the water supply valve 34 is directed to the bottom region of the water tub 11 together with the detergent by way of the detergent supply device 20, the resulting detergent dissolved water begins to be introduced into a space between the water tub 11 and the drum 12 until the detergent dissolved water reaches the bubble generation water level (e.g., a height of 5 cm or less from the surface of the drum 12).

Figure 3:
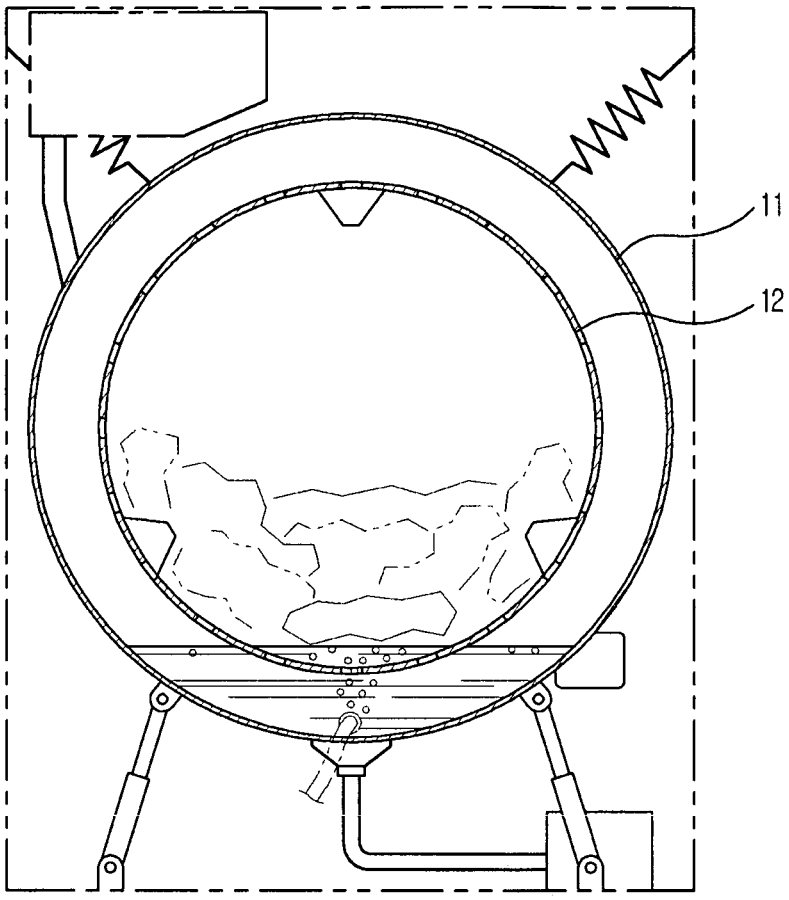

In FIG. 3, the circulating pump 50 is operated following the supply of the detergent dissolved water, causing the detergent dissolved water discharged from the circulating pump 51 to be introduced into the circulating nozzle 53 through the circulating pipe 52. The detergent dissolved water is reduced in pressure while passing through the circulating nozzle 53 in the form of a venturi tube, resulting in expansion of a circulating flow path. This expanded circulating flow path allows the interior air of the drum 12 to be introduced into the circulating nozzle 53 through the air inlet hole 54. The air introduced into the circulating nozzle 53 is ejected into the space between the water tub 11 and the drum 12, creating air droplets in the detergent dissolved water supplied into the space between the water tub 11 and the drum 12.

Figure 4:
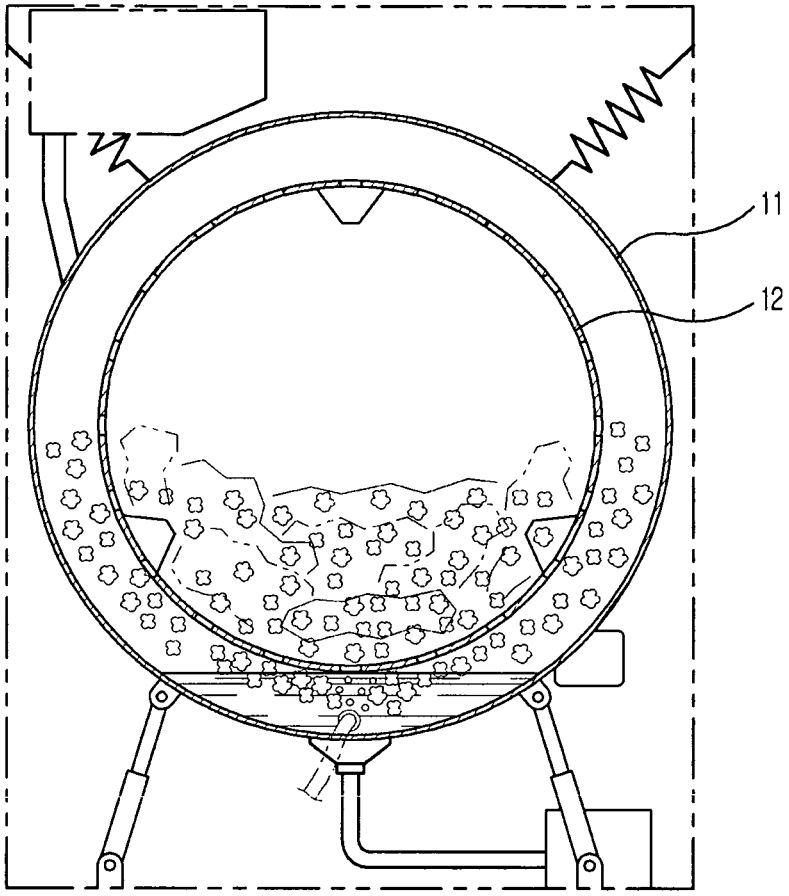

In FIG. 4, the air droplets created in the space between the water tub 11 and the drum 12 float up to the detergent dissolved water surface between the water tub 11 and the drum 12, thereby forming bubbles to move upward from the space between the water tub 11 and the drum 12. Then, the bubbles enter the drum 12 through the holes 13 perforated in the drum 12 and are dispersed in the drum 12. Here, the resulting bubbles are obtained via combination of the detergent and the air droplets. When the bubbles generated between the water tub 11 and the drum 12 enter the interior of the drum 12, the bubbles may pass through an opening perforated in a rear surface of the drum 12, or may pass through a peripheral surface as well as the rear surface of the drum 12.

Figure 5:
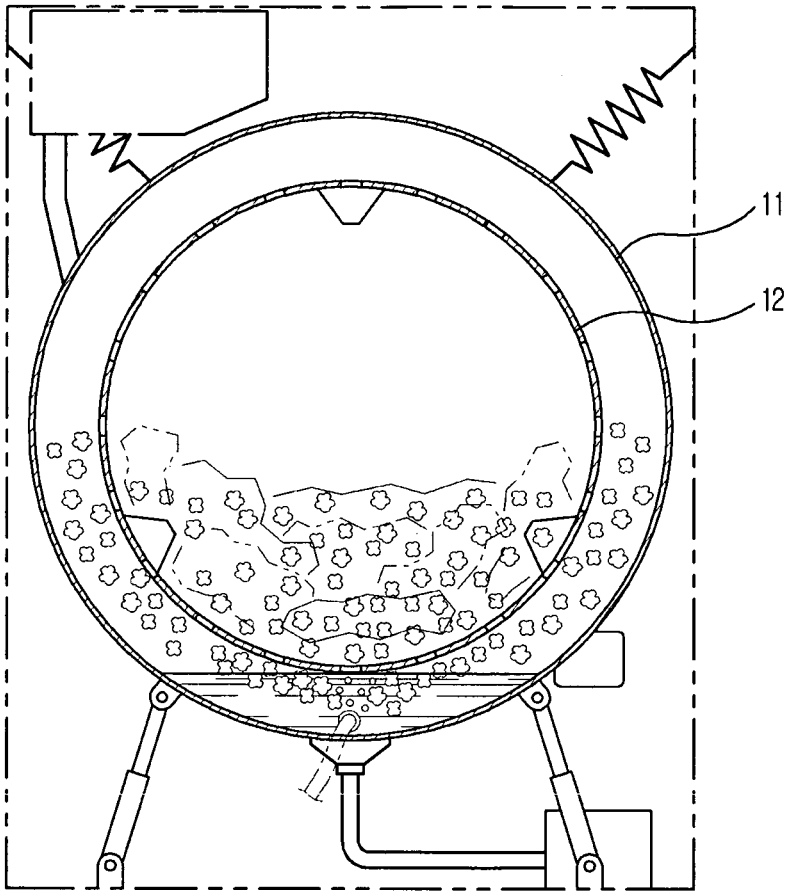

In FIG. 5, the bubbles generated via combination of the detergent and the air droplets begin to rise in the interior of the drum 12 while accumulating on the detergent dissolved water surface, and after a predetermined time (approximately, 3 minutes) passes, are dispersed throughout the interior of the drum 12, causing the level of the bubbles to rise. As the level of the bubbles rises, the bubbles act to cover the fabric input into the drum 12, causing the high density detergent present on surfaces of the bubbles to be adsorbed into the fabric. Once the generation of the bubbles is stabilized, the level of the detergent dissolved water drops below the surface of the drum 12, i.e. to a height in the space between the water tub 11 and the drum 12.

Figure 6:
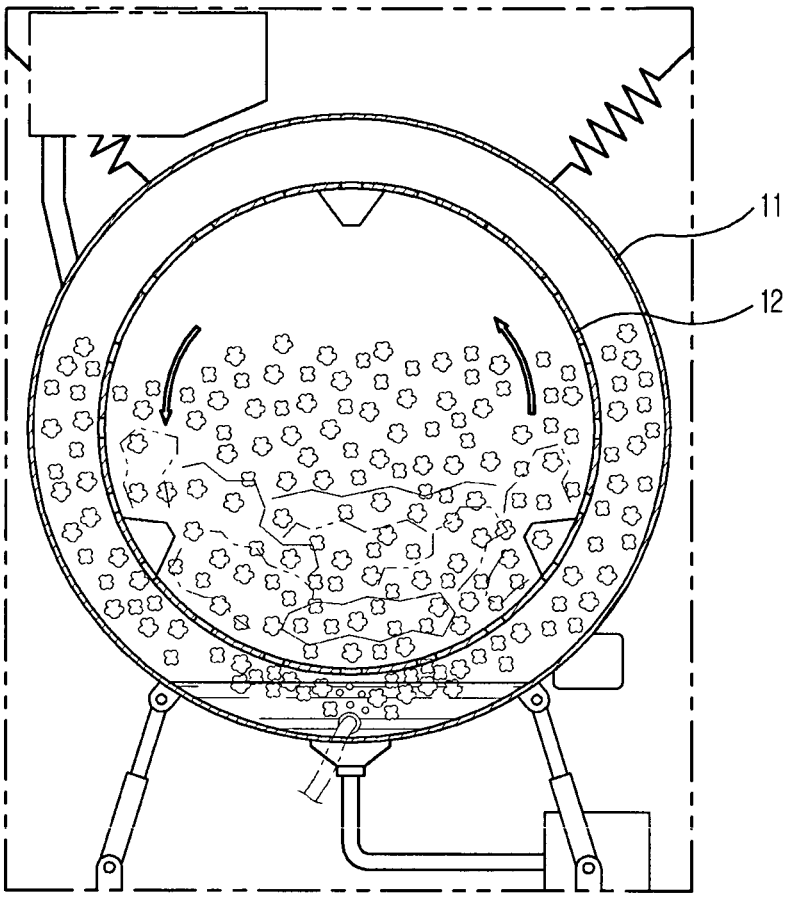

In FIG. 6, when the level of the bubbles reaches a wash water level at which the fabric input into the drum 12 is sufficiently wet, the drum 12 is rotated to cause the high density detergent present on the surfaces of the bubbles to be adsorbed into the fabric, allowing the fabric input into the drum 12 to be washed using the bubbles.

Figure 7:
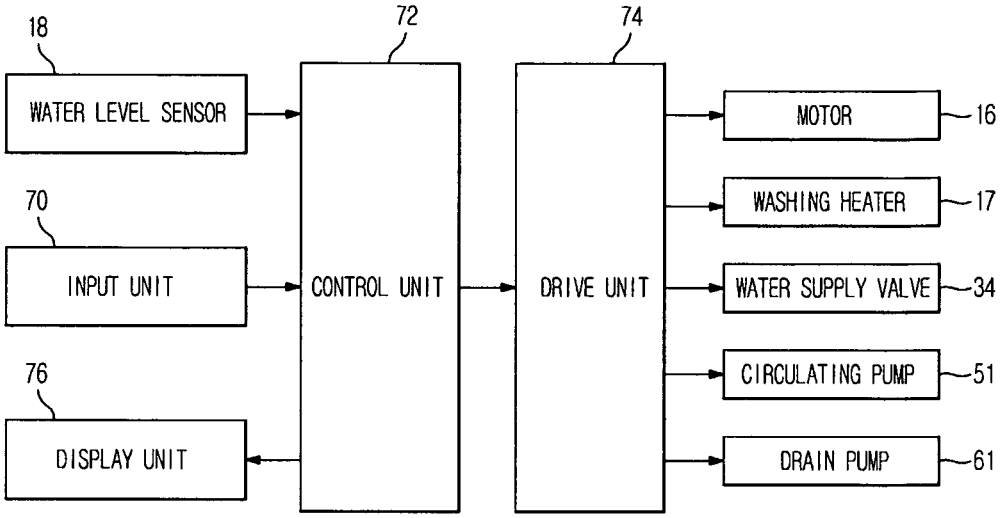
FIG. 7 is a control block diagram of the washing machine according to the embodiment.

FIG. 7 is a control block diagram of the washing machine according to the embodiment. There is illustrated an input unit 70, a control unit 72, a drive unit 74, and a display unit 76.

The input unit 70 inputs operational information, such as a washing course selected by the user (e.g., a standard course or a functional clothes washing course), dehydration RPM, addition of rinsing, etc., to the control unit 72.

The control unit 72 is a microcomputer to control general operations of the washing machine, such as washing, rinsing, dehydration, etc., according to the operational information input from the input unit 70. With relation to the functional clothes washing course, to provide an algorithm that may achieve washing performance using bubbles even while substantially preventing the clothes from being damaged by mechanical force, the control unit 72 stores motor RPM, motor drive operation rate (motor On/Off time), bubble generating operation rate (circulating pump On/Off time), and wash time.

Accordingly, upon washing of functional clothes using bubbles, the control unit 72 controls the motor RPM, motor drive operation rate, and bubble generating operation rate, thereby controlling operation of the motor 16 and the circulating pump 51 to realize an effective washing operation.

The drive unit 74 drives the motor 16, washing heater 17, water supply valve 34, circulating pump 51, drain pump 61, etc. according to a drive control signal of the control unit 72.

The display unit 76 displays operating conditions of the washing machine according to a display control signal of the control unit 72.

Hereinafter, an operating sequence and effects of the washing machine having the above described configuration and a control method of the washing machine will be described.

Figure 8:
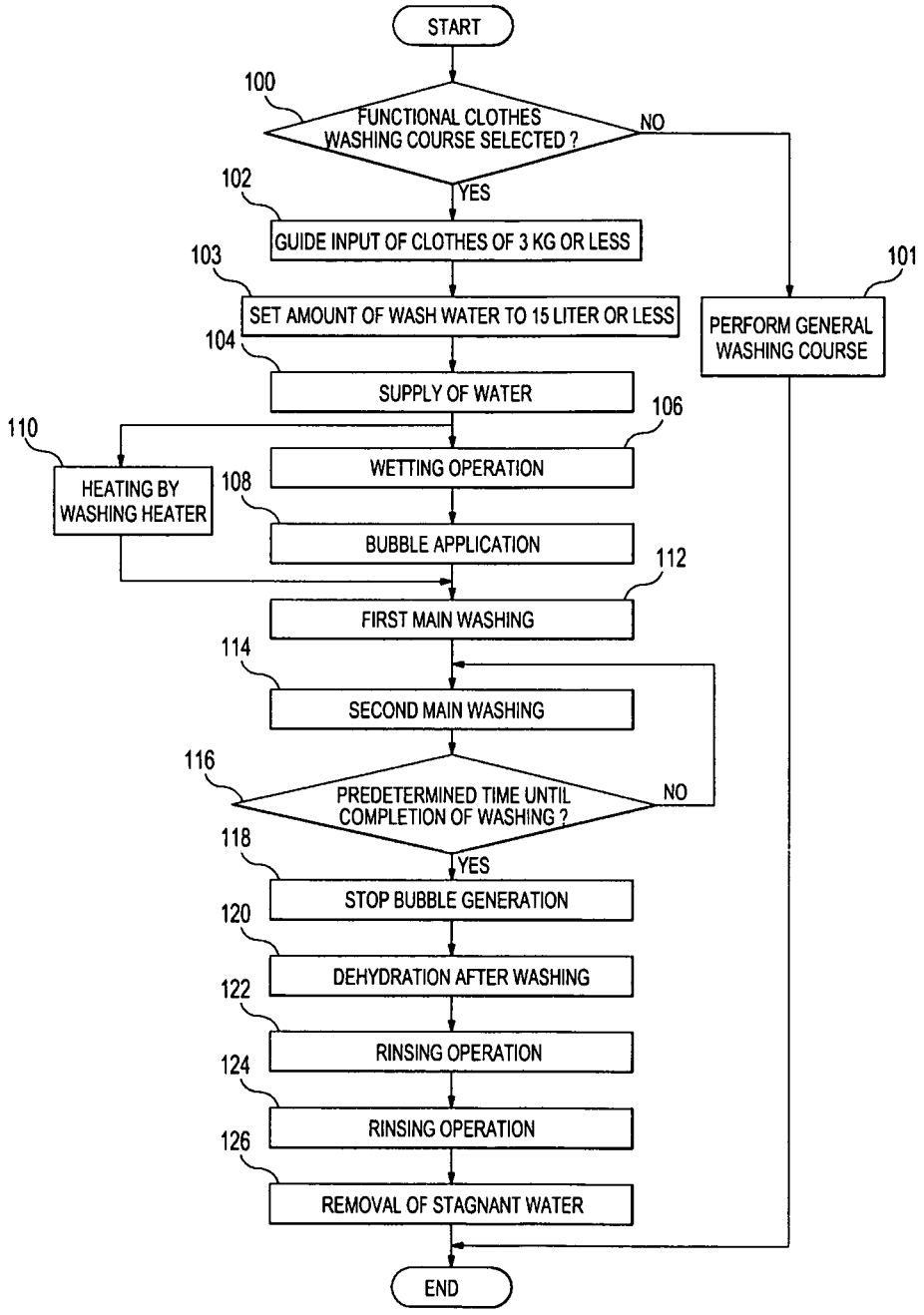
FIG. 8 is a flow chart illustrating a control sequence for washing of functional clothes using bubbles in the washing machine according to the embodiment.

FIG. 8 is a flow chart illustrating a control sequence for washing of functional clothes using bubbles in the washing machine according to the embodiment. This provides a control method to achieve washing performance while maintaining the functionality of functional clothes.

If the user selects the functional clothes washing course after putting functional clothes, such as sports clothes, outdoor clothes, or the like, into the drum 12, information of the washing course selected by the user is input to the control unit 72 via the input unit 70.

The control unit 72 determines based on the washing course information input from the input unit 70 whether or not the washing course selected by the user is the functional clothes washing course (100). If the selected washing course is not the functional clothes washing course, a general washing course is performed in the same manner as the prior art (101).

If it is determined from the operation 100 that the washing course selected by the user is the functional clothes washing course, the control unit 72 omits a weight sensing operation to reduce damage to the clothes, and guides input of clothes of 3 Kg or less via the display unit 76 (102). Thereafter, the control unit 72 sets the amount of wash water to a predetermined value (approximately, 15 liters) or less (103).

The reason why setting the amount of wash water to the predetermined value or less is because it has been experimentally found that the amount of wash water may cause damage to functional clothes.

Thereafter, the control unit 72 controls the water supply valve 34 to supply the detergent dissolved water required for bubble generation, allowing water (i.e. wash water) to be supplied into the water tub 11 by way of the first water supply pipe 32 and the detergent supply device 20. In this case, the detergent in the detergent supply device 20 is dissolved in the supplied water (wash water), thereby being introduced into the water tub 11 through the second water supply pipe 33 and the water supply nozzle 35 together with the water (wash water). Thereby, as shown in FIG. 2, the resulting detergent dissolved water is supplied below the water tub 11 (i.e. into the space between the water tub 11 and the drum 12) (104).

Once the detergent dissolved water is supplied, the control unit 72 performs a wetting operation to wet the functional clothes received in the drum 12 prior to performing a main washing operation using bubbles (106).

During the wetting operation, a drive period of the motor 16 is controlled to a predetermined first time (approximately, 10 seconds) or less so as to frequently rotate the drum 12, allowing the functional clothes to frequently contact the detergent dissolved water of a low density or the water (although the functional clothes are actually smeared with the detergent dissolved water, the detergent is not sufficiently dissolved yet and therefore, the detergent dissolved water in contact with the clothes may be naturally referred to as the water). Since main components of the functional clothes are polyester and nylon having characteristics of low water absorption, to facilitate initial wetting for realization of washing performance, the functional clothes may need to frequently come into contact with the water for a short time to uniformly adsorb the water throughout the clothes surface. For example, a drive period of the motor 16 during the wetting operation is set to a drive operation rate of 2"/5" (2 seconds On/5 seconds Off), 3"/4" (3 seconds On/4 seconds Off), and 4"/3" (4 seconds On/3 seconds Off). That is, a total drive period of On time and Off time of the motor 16 is programmed so as not to exceed a predetermined time (approximately, 10 seconds). Here, if the On time of the motor 16 is set to be long, damage to clothes by mechanical friction may occur and therefore, the On time of the motor 16 may be set to 4" or less.

Accordingly, the motor 16 is frequently rotated by a short drive interval (the sum of On time and Off time) during a performance time of the wetting operation (approximately, 5 minutes), allowing the functional clothes to frequently come into contact with the water.

Thereafter, the control unit 72 operates the circulating pump 51 after supply of the detergent dissolved water, generating bubbles to dampen mechanical force that will be generated in a following main washing operation and allowing the bubbles to be applied to the functional clothes that are substantially stationary (108).

During the bubble application, the bubbles are generated according to a preset bubble generating operation rate (3 minutes On/30 seconds Off) after heating of the detergent dissolved water, to apply the detergent dissolved water to be applied to the functional clothes. This may enhance washing performance in the following main washing operation. The generation of the bubbles via operation of the circulating pump 51 is as shown in FIGS. 2 to 6.

If the circulating pump 51 is operated, the water received in the water tub 11 is guided into the pump case 40 through the connection hose 41 and in turn, the water guided into the pump case 40 is reintroduced into the bottom region of the water tub 11 through the circulating pipe 52, enabling circulation of the water. In this case, when the circulating water passes through the circulating nozzle 53 after passing through the circulating pipe 52, the pressure of the water is suddenly reduced, causing air to be naturally introduced into the circulating nozzle 53 through the air inlet hole 54. Thereby, air droplets are ejected into the water (the detergent dissolved water) reintroduced into the bottom region of the water tub 11, forming bubbles on the detergent dissolved water surface via combination with the detergent.

The bubbles generated via combination of the detergent and the air droplets begin to rise in the interior of the drum 12 and are dispersed throughout the interior of the drum 12 after the predetermined time (approximately, 3 minutes) passes, thereby allowing the detergent dissolved water to be effectively transmitted to the functional clothes located in the drum 12.

After completion of the wetting operation and the bubble application and prior to initiating the main washing operation, the control unit 72 operates the washing heater 17 to heat the water to a preset temperature (not exceeding 30° C.) (110). In this case, the reason why the preset temperature does not exceed 30° C. is to realize an effective temperature to achieve washing performance without damage to the surface of the functional clothes.

After the bubbles are applied to the surface of the functional clothes, to perform the main washing operation using the bubbles, the control unit 72 performs a first main washing operation by rotating the drum 12 at a preset motor RPM (approximately, 40 RPM or less) and a preset first drive operation rate (for example, 2 seconds On/38 seconds Off) (112). The first main washing operation serves to loosen the functional clothes to allow mechanical force to be uniformly applied to the functional clothes.

The first main washing operation may have the effect of not only uniformly dispersing the clothes so as not to clump, but also substantially soaking the clothes.

Subsequently, the control unit 72 performs a second main washing operation by rotating the drum 12 at a second drive operation rate of the motor 16 (for example, 4 seconds On/58 seconds Off) higher than the drive operation rate in the first main washing operation to raise the mechanical force stepwise (114). The second main washing operation serves to remove sweat, contaminants, or the like from the functional clothes while mixing the detergent dissolved water of a high density on the surfaces of the bubbles with the functional clothes. In this case, the bubbles may act to dampen falling force caused upon rotation of the drum 12 and frictional force of the functional clothes, thereby preventing frictional damage to the functional clothes.

The control unit 72 limits a total operation time of the motor 16 within a second time (approximately, 6 minutes)

according to a drive operation rate of the motor 16 for a total washing time (approximately, 30 minutes) of the first main washing operation and the second main washing operation. If the washing time exceeds the above time, the water repellency as one of the functionalities of the functional clothes may be deteriorated to a second grade when a washing operation is repeated 30 times or more. Therefore, the functional clothes may have properties not to satisfying the regulations of the Korean Consumer Agency and standards of certification organizations.

A valuation method and valuation basis per water repellency grade are shown in FIG. 9.

FIG. 9 is a table illustrating a valuation basis per water repellency grade. The lower the water repellency grade, the more serious the deterioration in the functions of the functional clothes.

in FIG. 9, water repellency of a fifth grade represents that a clothes surface has no adhesion and wetting, water repellency of a fourth grade represents that a clothes surface has a little adhesion and wetting, water repellency of a third grade represents that only a region of a clothes surface in contact with water becomes wet, water repellency of a second grade represents that an entire clothes surface is partially wet, and water repellency of a first grade represents that a clothes surface and an opposite side thereof are completely wet.

Referring back to FIG. 8, subsequently, the control unit 72 determines whether it is a predetermined time (approximately, 3 minutes) until the washing time of the functional clothes using bubbles is completed (116). If the predetermined time has not yet been reached, the control unit 72 returns to the operation 114 to perform the following operations. If the predetermined time has been reached, the control unit 72 stops the circulating pump 51 to stop the generation of bubbles (118).

Thereafter, if the washing operation of the functional clothes using bubbles is completed, the control unit 72 performs dehydration by rotating the motor 16 at 600 RPM for 4 minutes or more to achieve dehydration performance while reducing damage to the functional clothes (120).

After completion of the dehydration, the control unit 72 performs a rinsing operation a preset number of rinsing times (approximately, 3 times), to achieve rinsing performance (122). In this case, similar to the dehydration after washing, dehydration during rinsing is performed by rotating the motor 16 at 600 RPM for 4 minutes or more to achieve dehydration performance while reducing damage to the functional clothes. However, intermediate dehydration before the last rinsing is performed only to sweep away water from the clothes surface by rotating the motor 16 at 100 RPM only for 1 minute to further reduce damage to the clothes.

After the rinsing operation is completed, similar to the dehydration after washing and the dehydration during rinsing, the control unit 72 performs final dehydration by rotating the motor 16 at 600 RPM for 4 minutes or more to achieve dehydration performance while reducing damage to the clothes (124).

Meanwhile, the control unit 72 performs unbalance control upon the dehydration after washing, upon the dehydration during rinsing, and upon the final dehydration. The unbalance control is applicable in any available conventional method.

After completion of the final dehydration, the control unit 72 rotates the drum 12 forward and reverse at a preset motor RPM (approximately 70 RPM, at which the clothes become adhered to a wall surface of the drum) and a drive operation rate (for example, 5 seconds On/10 seconds Off) for a predetermined time (approximately, 1-2 minutes), so as to remove water remaining on the surface of the functional clothes and thereafter, ends the washing of the functional clothes (126).

Although the embodiment exemplifies that the circulating pump 51 and the drain pump 61 are symmetrically arranged at opposite sides of the pump case 40, the embodiment of the present invention is not limited thereto, and the circulating pump 51 and the drain pump 61 may be arranged in parallel in a front rear region of the body 10. In addition, the embodiment of the present invention is applicable to any configuration to achieve circulation and drainage of water.

As is apparent from the above description, bubble washing may effectively remove sweat, contaminants, etc. without damage to the surface or fiber structures of functional clothes, achieving washing performance of a washing machine. Further, by performing a rinsing operation at the sufficient number of rinsing times, rinsing performance sufficient to rinse residual detergent out of a surface of the clothes as well as dehydration performance with reduced damage to the clothes may be accomplished, resulting in functionality of the clothes.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A control method of a washing machine having a drum to receive clothes therein and a motor to rotate the drum, comprising:

determining whether a washing course of functional clothes is selected;

after the washing course of the functional clothes is selected, omitting a weight sensing operation and controlling supply of water to a preset amount;

performing a wetting operation to cause the clothes to adsorb the water by driving the motor at a period of a first time;

after the wetting operation, generating bubbles from detergent-dissolved water and applying the bubbles to the clothes; and performing a washing operation using the bubbles, the washing operation including a first washing duration of driving the motor at a first operation rate and a second washing duration of driving the motor at a second operation rate higher than the first operation rate to wash the clothes having the bubbles applied thereto, wherein the second washing duration is performed after the first washing duration.

2. The control method according to claim 1, wherein the functional clothes include clothes having water repellency including hiking clothes, ski wear, and golf wear.

3. The control method according to claim 1, wherein the generation of the bubbles includes:

preparing the detergent dissolved water by supplying the water and detergent into a water tub;

heating the detergent dissolved water to a preset temperature; and ejecting air droplets into the heated detergent dissolved water, so as to generate the bubbles.

4. The control method according to claim 3, wherein the preset temperature is set to 30° C. or less, so as not to damage the functional clothes.

5. The control method according to claim 1, wherein the first washing duration is configured to soak the clothes by driving the motor at the first operation rate; and the first washing duration is configured to wash the clothes by driving the motor at the second operation rate.

6. The control method according to claim 5, wherein the first operation rate is 2 seconds On/38 seconds Off, and the second operation rate is 4 seconds On/58 seconds Off.

7. The control method according to claim 5, wherein a total operation time of the motor when the motor is operated at the first operation rate and the second operation rate is within a second time.

8. The control method according to claim 7, wherein the second time is approximately 6 minutes.

9. The control method according to claim 1, wherein a drive period of the motor is the drive operation rate of the motor as the sum of a motor On time and a motor Off time, and the first time is approximately 10 seconds.

10. The control method according to claim 9, wherein the motor On time of the drive period of the motor is 4 seconds or less.

11. The control method according to claim 1, further comprising:

rotating the drum forward and reverse for a predetermined time after final dehydration, to remove the water remaining on a surface of the clothes.

12. The control method according to claim 1, further comprising:

after the washing course of the functional clothes is selected, guiding a user to input a predetermined weight or less of the clothes before supply of the water.

* * * * *